United States Patent [19]

Nemes et al.

[11] 4,361,414

[45] Nov. 30, 1982

[54] EQUIPMENT FOR THE DELIVERY OF SLURRIES AND FOR REFINEMENT DURING DELIVERY

[75] Inventors: Sándor Nemes; Karoly Solymos, both of Tatabánya; László Barna, Budapest; Tibor Bognár, Budapest; József Szigetvári, Budapest; Ferenc Vajda, Budapest; Endre Tornai, Budapest, all of Hungary

[73] Assignees: Banyaszati Kutato Intezet, Budapest; Tatabanyai Szenbanyak, Tatabanya, both of Hungary

[21] Appl. No.: 171,547

[22] Filed: Jul. 23, 1980

[51] Int. Cl.[3] ..... F04B 1/08

[52] U.S. Cl. ..... 415/83; 415/121 B; 366/304

[58] Field of Search ..... 415/83, 84, 86, 65, 415/121 B; 366/303, 304

[56] References Cited

U.S. PATENT DOCUMENTS

| | | | |
|---|---|---|---|
| 2,606,502 | 8/1952 | Carlson | 415/83 |
| 2,639,901 | 5/1953 | Teale | 366/303 |
| 4,011,027 | 3/1977 | Selder | 415/83 |
| 4,201,487 | 5/1980 | Backhaus | 366/304 |

FOREIGN PATENT DOCUMENTS

| | | | |
|---|---|---|---|
| 872502 | 7/1961 | United Kingdom | 366/304 |
| 1388889 | 3/1975 | United Kingdom | 366/303 |
| 709152 | 1/1980 | U.S.S.R. | 366/304 |

OTHER PUBLICATIONS

S. P. Hutton et al., "The Damage Capacity of Some Cavitating Flows", pp. 427–438.

A. Koutny, "Cavitation Erosion Resistance of Materials in Laboratory and Operating Conditions", pp. 451–511.

G. Y. Sebestyen et al., "Determination of the Intensity of Cavitation Erosion", pp. 957–966.

M. Yamamasu et al., "Large Bubble Cavitation in Radial Blade Impellers", pp. 1233–1244.

*Primary Examiner*—Louis J. Casaregola

*Attorney, Agent, or Firm*—Young & Thompson

[57] ABSTRACT

The invention relates to an equipment for the delivery of slurries and for their refinement during delivery, which has a housing provided with axial inlet opening and tangential discharge opening, furthermore a disc-shaped stationary part in the housing with a concentric opening adjoining the inlet opening, and disc-shaped rotary part arranged opposite the stationary part. Rods are concentrically arranged according to the invention alternately on the stationary part and rotary part in such a way, that the rods of the stationary part point toward the rotary part, and the rods of the rotary part point toward the stationary part, and the rotary part has a jacket surrounding the rods arranged along the largest diameter circle of the stationary part, said jacket being perforated with holes in radial direction. The rod-lines of the stationary and rotary part, as well as the jacket of the rotary part and their holes bring about an intensive turbulence, resulting partly in powerful impact and friction between the solid particles of the slurry and partly in cavitation, which initiate the explosive disintegration of the particles. At the same time the refined slurry arriving at the discharge opening, has a high exit velocity, whereby the lift of the machine is unusually high.

4 Claims, 2 Drawing Figures

EQUIPMENT FOR THE DELIVERY OF SLURRIES AND FOR REFINEMENT DURING DELIVERY

The invention relates to equipment for the delivery of slurries and their refinement during delivery.

The demand for the delivery of various slurries (e.g. from the place of production to the location of utilization), and for their refinement the need for the most intensive dispergation of the solid particles being very frequent in the various fields of the industry. By the term "slurry" generally liquid with solid substance content is understood. Such slurries are used in the construction, chemical, food, paint, etc., industry. There are such specially constructed pumps which are suitable for the delivery of certain types of slurry. These pumps are usually suitable for their purpose, i.e. are capable of the delivery of the slurry prepared in advance, to the destination. However, separate equipment is necessary for the preparation of the slurry of suitable fineness, because the slurry pump alone is either unable to dispergate (refine) the delivered slurry, or can do so only to an insignificant extent.

At the same time various devices exist for the refinement of slurries (see for instance Hungarian Pat. No. 162,529). These devices use impellers with toothed rims next to each other, and disc which cut (shear) the solid particles of the slurry flowing between them upon impact with each other and with the teeth.

The known slurry-refining devices are not suitable to carry the slurry to be refined, because the slurry flowing between the stationary and rotary parts has insufficient exit speed at the location of the outlet.

The invention is aimed at elimination of above deficiencies of the known devices.

The object of the invention is to provide equipment suitable for the delivery of slurries and refinement of the delivered slurry at the same time, thus making the extra slurry refining devices unnecessary in the specific technological processes, i.e. it permits significant saving in investment, operation and energy.

The equipment according to the invention for the delivery of slurries and refinement during delivery has a housing provided with an axial inlet and a tangential outlet, opening, furthermore the equipment has a disc-shaped stationary part provided with a concentric opening adjoining the inlet opening arranged in the housing, and another disc-shaped rotary part arranged opposite the stationary part, and rods are concentrically arranged on the stationary and rotary part according to the invention in such a way, that the rods of the stationary part point toward the rotary part, while the rods of the rotary part point toward the stationary part, and the rotary part has a jacket surrounding the rods arranged along the largest diameter circle of the stationary part, said jacket being perforated with holes the radial direction.

The number of rods arranged along one circle increases outward in the radial direction.

The rods are preferably of circular or polygonal cross section. The gap between two adjacent rods of the stationary part and rods of the rotary part in the radial direction is suitably $\frac{1}{3}$–$\frac{1}{8}$-th of the rod diameter.

It is advisable to cover the rods with elastic material.

In the equipment according to the invention the rods of the stationary and rotary part, as well as the jacket of the rotary part and its radial holes bring about an extremely intensive turbulence in the delivered slurry, resulting partly in a powerful impact and friction between the solid particles of the slurry and partly in cavitation which initiates the explosive disintegration of the particles. At the same time the refined slurry arriving at the discharge opening has a high exit velocity, therefore the equipment has a high lift unusual in slurry refining machines.

The invention is described by way of an example of the embodiment illustrated in the accompanying drawing, in which.

Figure 1:
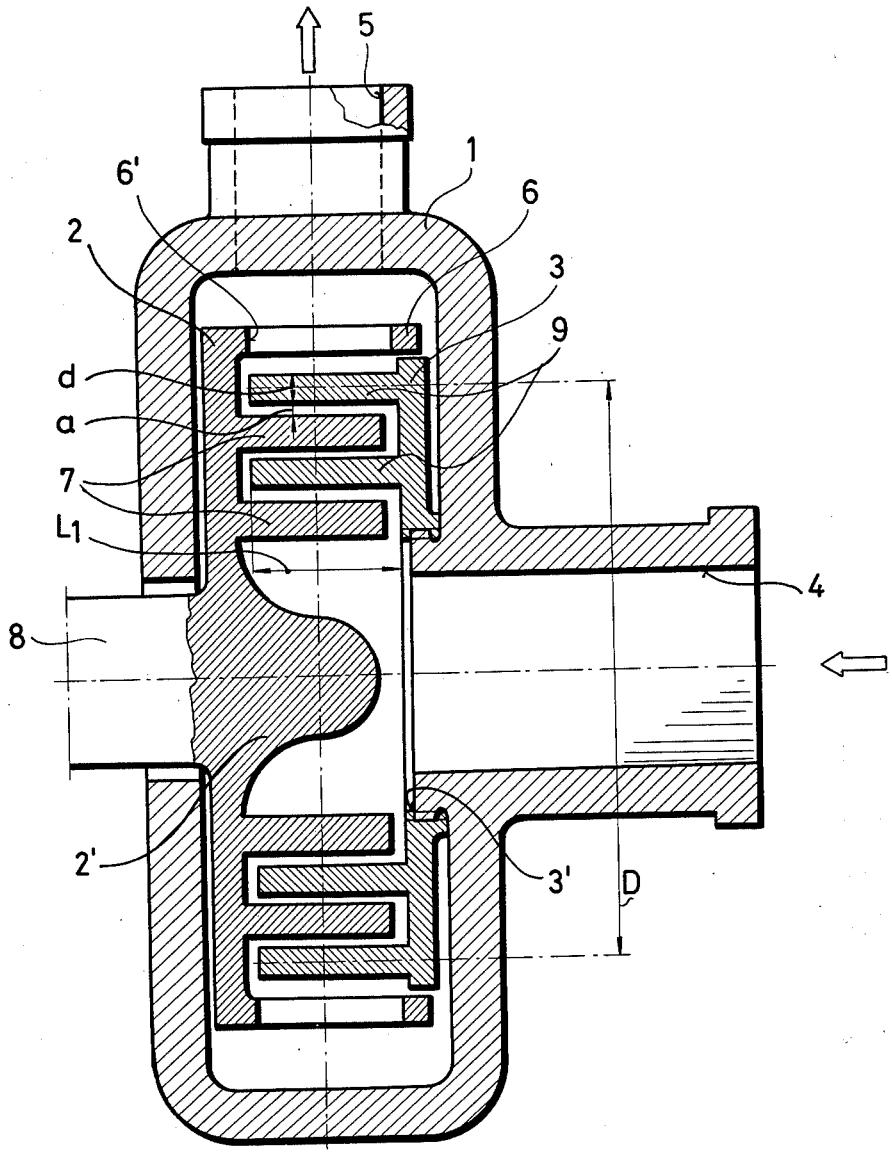
FIG. 1 is a longitudinal section of the equipment according to the invention.

The equipment shown in the drawing has a housing 1 of a shape usual in a single-stage turbine pump, provided with an axial inlet opening 4 and tangential discharge opening 5, made of or covered with wear-resistant material.

A disc-shaped stationary part 3 is arranged in the housing 1 screwed onto the thread of the inner end of the inlet opening 4, said stationary part 3 having a concentric opening 3' adjoining the inlet opening 4. A shaft 8 with suitable packing is introduced the side of house 1 opposite the inlet opening 4, arranged rotatably in bearings (not shown), and driven for instance by an electric motor. The shaft 8 carries a disc-shaped rotary part 2 which is parallel with the stationary part 3 and provided with a baffle element 2' of usual shape in the centre facing the stationary part 3. Rods 7, 9 are concentrically arranged alternately on the rotary part 2 and the stationary part 3. The rods 7 of the rotary part 2 point toward the stationary part 3, while the rods 9 of the stationary part point toward the rotary part 2. (For the sake of simplicity FIG. 1 shows only the rods 7, 9 in the plane of the section.) Rods 7, 9 are uniformly distributed along the concentric circles, and their number increases with the increase of the circles' radii. Rods 7, 9 are of circular cross section in the given case, but they may be of polygonal or other cross sections as well. Rods 7 can be produced in one piece with the rotary part 2, and rods 9 with stationary part 3 (e.g. by casting), but they may be separate elements fixed to the respective parts. The rods 7, 9 similarly to the housing 1, rotary part 2 and stationary part 3, are of or at least covered with wear-resistant material of high strength.

Distance "a" between the adjacent rods 7, 9 in radial direction is $\frac{1}{3}$–$\frac{1}{8}$-th of the rod diameter "d".

Figure 2:
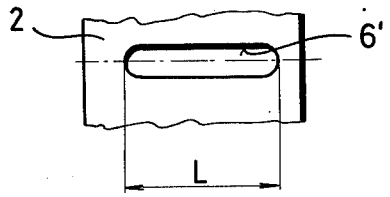
FIG. 2 is a plan view of the hole in the rotary part of the equipment according to FIG. 1.

The rotary part 2 has a jacket 6 surrounding the rods 9 arranged along the circle of the largest diameter "D" of the stationary part 3, said jacket being provided with radial holes 6' (FIG. 2). Holes 6' are uniformly distributed along the circumference, and their length "L" in axial direction is the same as the length "$L_1$" of the rods 9.

The described equipment functions as follows:

The non-refined slurry of maximum 60 weight % solid content admitted through the inlet opening 4 (maximum grain size corresponds to the minimum gap between the rods) is carried by the baffle element 2' of the high-speed rotary part 2 into the space between the rods 7 and 9, where, due to the very intensive turbulence the solid parts are exposed to extremely intensive disintegration partly as a result of impacts due to the very intensive turbulence, and partly by cavitation. The jacket 6 of the rotary part 2 provided with holes 6' and the coacting rods 7, 9 force the refined slurry toward the discharge opening 5, through which it is carried in the pipeline (not shown) to the place of utilization.

Main technical data of existing experimental equipment are the following:

| | |
|---|---|
| Diameter of rotary part (2): | 234 mm |
| Width of rotary part jacket (6): | 76 mm |
| Number of holes (6') on jacket: | 37 |
| Diameter of rods (7, 9) (d): | 12 mm |
| Length of rods (7, 9) ($L_1$): | 48 mm |
| Number of rotary part rods (7) along | |
| $\phi$ 108 mm inner pitch circle: | 5 |
| $\phi$ 164 mm outer pitch circle: | 19 |
| Number of stationary part rods (9) along | |
| $\phi$ 136 mm inner pitch circle: | 14 |
| $\phi$ 192 mm outer pitch circle (D): | 31 |
| Diameter of inlet opening (4): | 76 mm |
| Diameter of discharge opening (5): | 50 mm |

Test data of the equipment measured with water:

| | |
|---|---|
| Power output of driving motor: | N = 22 kW |
| R.p.m.: | n = 1600 $min^{-1}$ |
| Lift: | H = 12 m |
| Efficiency: | $\mu$ = 9% |

Data of a specific plant experiment are the following:

Clay of 5 mm maximum grain size derived from brick works was mixed with water at 55 weight % solid content in a mixer. The obtained slurry was poured into equipment of the above characteristics. The refined slurry emerging from the equipment was of high dispersion and honey-like consistency.

Delivery of the slurry by the equipment was excellent and the delivered quantity was 650–950 l/min.

What we claim is:

1. Equipment for delivery of slurry and refinement during delivery, comprising a housing having an axial inlet opening and a tangential discharge opening, a disc-shaped stationary part in said housing and having a concentric opening communicating with said inlet opening, a disc-shaped rotary part opposite said stationary part, rods disposed in concentric circular series and alternately on said stationary part and said rotary part in such a way that said rods of each part point toward the other part, said rotary part having a jacket surrounding said rods, said jacket having holes extending therethrough in a radial direction, said holes being each completely surrounded by the material of said jacket, there being a gap between the two adjacent stationary part rods and the rotary part rod in the radial direction providing a refinement of slurry by the cavitation and turbulence effect of said rods, said gap being $\frac{1}{3}$–$\frac{1}{8}$th of the rod breadth.

2. Equipment as claimed in claim 1, wherein each number of said rods in each said circular series is such that the numbers have no common divisor.

3. Equipment as claimed in claim 1, said holes being in the form of slots elongated in a direction parallel to the axis of said rotary part.

4. Equipment as claimed in claim 1, the radially outermost said circular series of rods being spaced radially from said jacket a distance substantially greater than the width of said gap.

* * * * *